US007972043B2

(12) United States Patent
Schutte

(10) Patent No.: US 7,972,043 B2
(45) Date of Patent: Jul. 5, 2011

(54) BUILT-IN LIGHT FIXTURE

(75) Inventor: Bernhard Schutte, Langenfeld (DE)

(73) Assignee: **BA*RO GmbH & Co. KG**, Leichlingen (DE)

( * ) Notice: Subject to any disclaimer, the term of this patent is extended or adjusted under 35 U.S.C. 154(b) by 265 days.

(21) Appl. No.: 12/379,320

(22) Filed: Feb. 19, 2009

(65) Prior Publication Data

US 2009/0207623 A1 Aug. 20, 2009

(30) Foreign Application Priority Data

Feb. 19, 2008 (EP) ..... 08003016

(51) Int. Cl.
*F21V 15/00* (2006.01)

(52) U.S. Cl. ..... 362/365; 362/147; 362/368; 362/371

(58) Field of Classification Search ..... 362/147, 362/148, 364, 365, 368, 269
See application file for complete search history.

(56) References Cited

U.S. PATENT DOCUMENTS

| | | | | |
|---|---|---|---|---|
| 4,232,361 | A | 11/1980 | Kelsall | |
| 4,459,648 | A | 7/1984 | Ullman | |
| 4,829,410 | A * | 5/1989 | Patel | 362/147 |
| 5,548,499 | A | 8/1996 | Zadeh | |
| 5,951,151 | A | 9/1999 | Doubeck et al. | |
| 6,082,878 | A * | 7/2000 | Doubek et al. | 362/365 |
| 6,132,069 | A | 10/2000 | Sato et al. | |
| 6,588,922 | B1 * | 7/2003 | DeCicco | 362/364 |
| 2007/0019418 | A1 | 1/2007 | Czech et al. | |
| 2008/0112171 | A1 * | 5/2008 | Patti et al. | 362/365 |
| 2009/0034261 | A1 * | 2/2009 | Grove | 362/294 |

FOREIGN PATENT DOCUMENTS

| | | |
|---|---|---|
| DE | 93 17 087 | 1/1994 |
| DE | 43 44 376 | 6/1995 |
| DE | 10 2005 031 173 | 1/2007 |
| DE | 10 2005 032 265 | 1/2007 |
| EP | 1 455 135 | 9/2004 |
| EP | 1 479 966 | 11/2004 |
| GB | 2 405 440 | 3/2005 |

* cited by examiner

*Primary Examiner* — Ali Alavi
(74) *Attorney, Agent, or Firm* — Clark & Brody

(57) ABSTRACT

The present invention relates to a built-in light fixture to be fitted in a suspended ceiling or similar, with a mounting ring (4) insertable into an opening in the ceiling and fixable by holding elements (6) and a light unit (3) which is attached in particular releaseably to the mounting ring (4), wherein fixed to the mounting ring (4) is a support frame (13) which defines a mounting space for the light unit (3) and has on its upper side facing away from the mounting ring (4) attachment means (18) for fixing the light unit (3) onto the support frame (13).

19 Claims, 4 Drawing Sheets

BUILT-IN LIGHT FIXTURE

Figure 1:
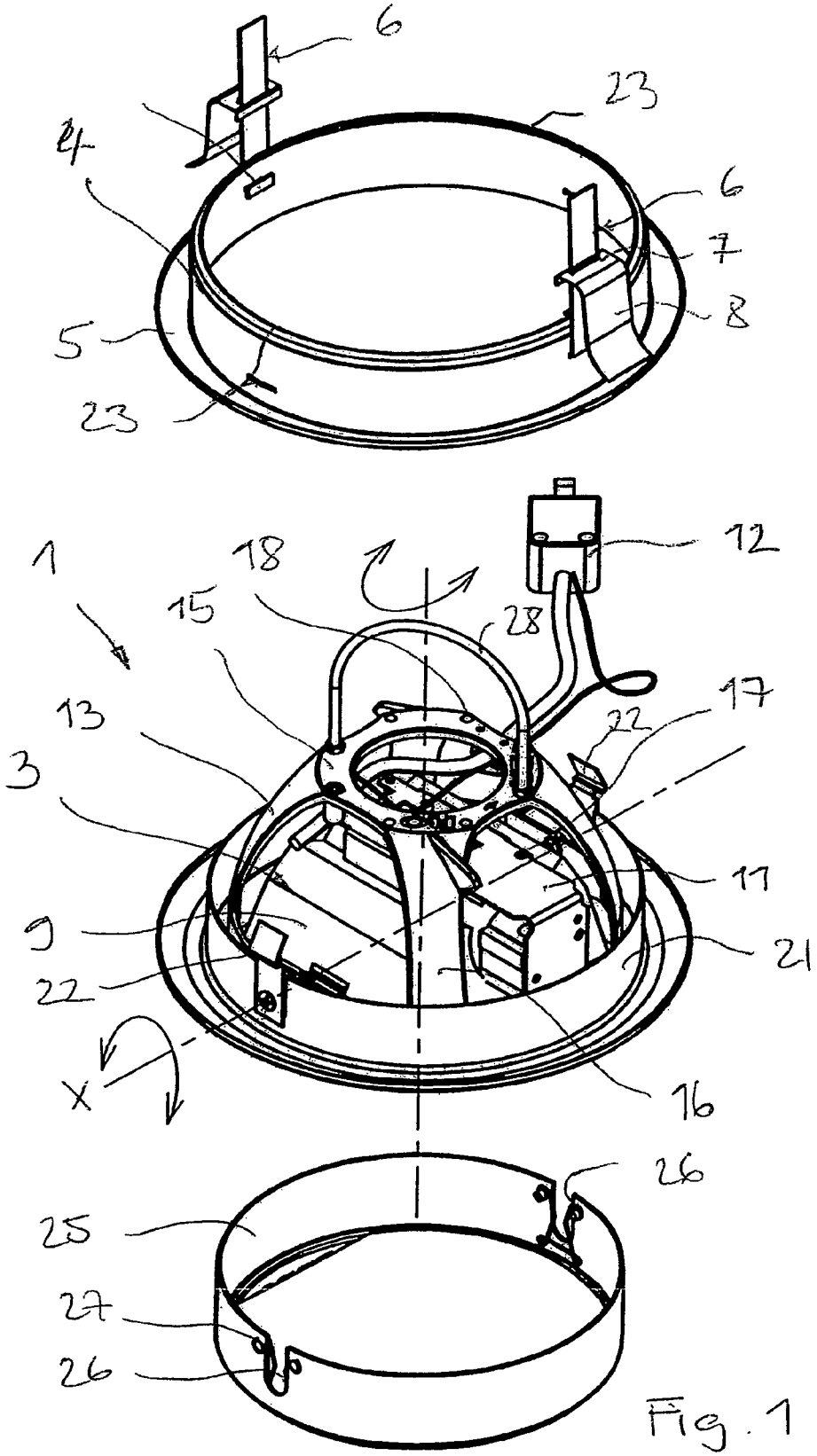

The present invention relates to a built-in light fixture to be fitted in a suspended ceiling or similar, with a mounting ring insertable into an opening in the ceiling and fixable by holding elements and a light unit which is attached in particular releaseably to the mounting ring.

Built-in light fixtures of this type to be fitted in a suspended ceiling, thin wall or similar are known in various embodiments. They have a light element which can be pushed into a ceiling opening from its rear-side end. A facing is provided here on the light outlet opening of the light element which projects over the outer edge of the light element so that the ceiling opening is covered and which, moreover, also forms an axial stop for the light when being fitted. Fixing of the known built-in light fixtures in the ceiling is generally implemented by means of a number of double leg springs which are affixed along the periphery of the light element and in the fitted state of the built-in light fixture in the ceiling in which they are fitted engage from behind due to elastic deformation and draw the facing towards the front side of the ceiling.

With these known built-in light fixtures it is partially considered to be disadvantageous that the known built-in light fixtures can only be changed with a degree of effort. If, for example, instead of a built-in light fixture with an upright illuminant a built-in light fixture with a horizontal illuminant is desired, it is necessary to change the whole built-in light fixture. The same applies if under certain circumstances the colour of the facing needs to be changed after painting the walls.

In order to counteract this problem a built-in light fixture is proposed in EP 1 455 135 B1 with which the light element is sub-divided into a mounting ring having the facing and carrying the holding elements and a light unit carrying the bulb socket which is connected releaseably to the mounting ring such that when the built-in light fixture is fitted, the mounting ring is removed from the light unit and so the light unit can be changed separately without any tools.

The known built-in light fixture has proved to be of value in practice. However, it is still complex to change a light unit for a light unit of a different type which is of different dimensions.

It is the object of the present invention to design a built-in light fixture of the aforementioned type which can be changed over more easily.

This object is achieved according to the invention in that fixed to the mounting ring is a support frame which defines a mounting space for the light unit and has on its upper side facing away from the mounting ring attachment means for fixing the light unit onto the support frame.

Therefore, the invention is based upon the idea of fixing the light unit not directly to the mounting ring, but by means of a support frame which defines a mounting space for the light unit and accommodates the latter. The mounting space is of a size such that it can accommodate all differently designed types of light units which are to be used with the built-in light fixture. Since, according to the invention, the light units are fitted to the support frame by means of the attachment means provided on the upper side of the support frame—i.e. from above—, it is possible, in a simple way, also to fit light units of different types in the support frame.

According to one embodiment of the invention provision is made such that the support frame has a number of struts arranged in particular evenly distributed around the periphery of the mounting ring and which in their lower region in particular are connected to the mounting ring and in their upper region carry the attachment means. The advantage of this open embodiment of the support frame is that parts of the light units fitted in the latter can pass through the struts and so the design of the light units is not or is only slightly effected by the dimensions of the support frame. Furthermore, any heat that develops can easily be discharged.

In a further version of this embodiment the struts are connected in their upper end region by a flat cover plate of the support frame on which the attachment means are also provided. The cover plate can have a central heat discharge opening in order to improve the heat discharge, it then advantageously being annular in form so as to correspond to the shape of the mounting ring.

According to one embodiment of the invention the attachment means are in the form of bore holes by means of which the light unit can be securely screwed onto the support frame. In this case it is only necessary to provide mounting bore holes corresponding to the bore holes on the light unit, and in particular on a holder of the latter. Light units of different designs can then easily be fitted on the support frame. It is only necessary to adjust the distance between the light unit or the holder and the cover plate of the support frame. For this purpose spacers of a pre-specified length, which are placed on the attachment screws, can be used.

With a further embodiment of the invention provision is made such that in its lower end region facing towards the mounting ring the support frame has a base ring which connects the lower ends of the struts to one another. In this way the support frame forms a compact and stable structural unit. In particular, the fitting of the support frame onto the mounting ring can also be undertaken by means of the base ring. This fitting can be implemented directly. With an alternative embodiment of the invention provision is made, however, such that the support frame is fixed onto the mounting ring by means of an intermediate ring which can be pushed into the mounting ring from the lower side of the latter and is connected releaseably to the mounting ring. The releaseable connection can be implemented in particular by means of a clamping or detent mechanism. For example, in its upper end region the intermediate ring can carry a number of detents which lock engage over the upper edge of the mounting ring when the intermediate ring is pushed into the mounting ring from the lower side of the latter. With a round design of the built-in light fixture, the advantage of this embodiment is that the intermediate ring can be rotated about the longitudinal axis of the built-in light fixture in relation to the mounting ring.

In a way known in its own right the light unit should be pivotable in relation to the mounting ring. For this purpose the support frame is advantageously attached pivotably to the mounting ring by means of bearing pins. When using an intermediate ring provision is preferably made such that the support frame is pivotably attached to the intermediate ring by means of bearing pins so that no particular precautions have to be taken in order to fix the intermediate ring onto the mounting ring. In this case the support frame preferably has bushings through which the bearing pins pass.

Furthermore, the built-in light fixture can have a filter holding ring which can be pushed into the mounting ring or into the intermediate ring and can be releaseably fixed onto the support frame by means of a clamping mechanism. In particular, the filter holding ring has the bearing pin by means of which the support pin is attached pivotably to the mounting ring or to the intermediate ring, and recesses corresponding to the bushings, and spring elements are provided on the filter holding ring in order to clamp fix the bearing pins or bushings in the recesses. The arrangement can be such that the filter holding ring can be moved pivotably in relation to the bushings.

Advantageously, provision is made such that the holding force of the clamping mechanism by means of which the intermediate ring and the mounting ring are connected to one another is stronger than the clamping mechanism by means of which the filter holding ring is fixed to the intermediate ring so that when the filter holding ring is released, the connection between the light unit and the mounting ring is not separated at the same time.

Finally, on the upper side of the support frame facing away from the mounting ring a spacer can be provided which defines a minimum required clearance above the support frame. In this way it is ensured that the built-in light fixture according to the invention can only be fitted in a wall or ceiling in which sufficient space is available and no heat accumulation can develop.

Moreover, according to a preferred embodiment provision is made such that the support frame is made of a heat-storing material such as for example aluminium. In this case the support frame can absorb heat which is produced by the light unit during operation.

Figure 2:
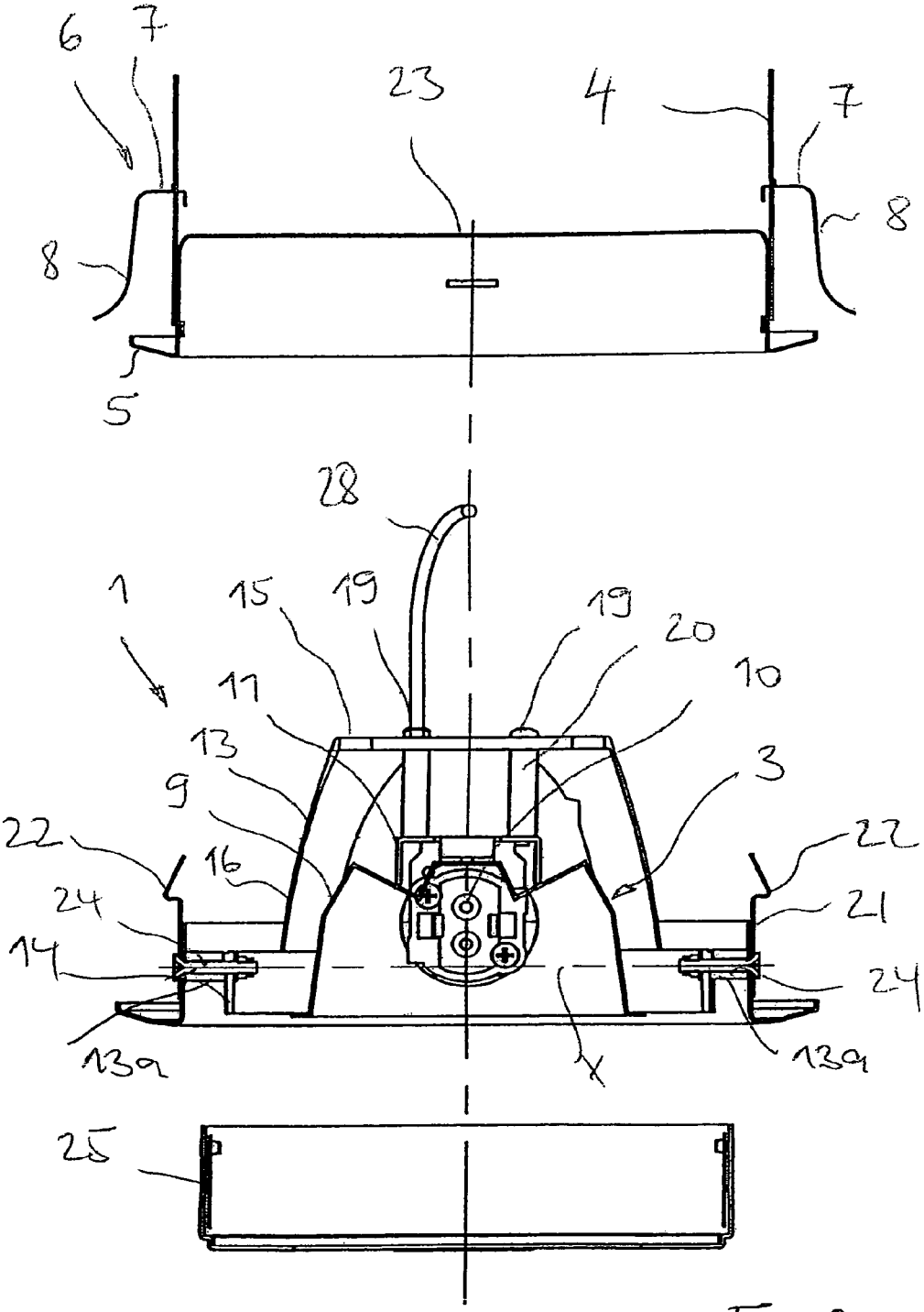
Figure 3:
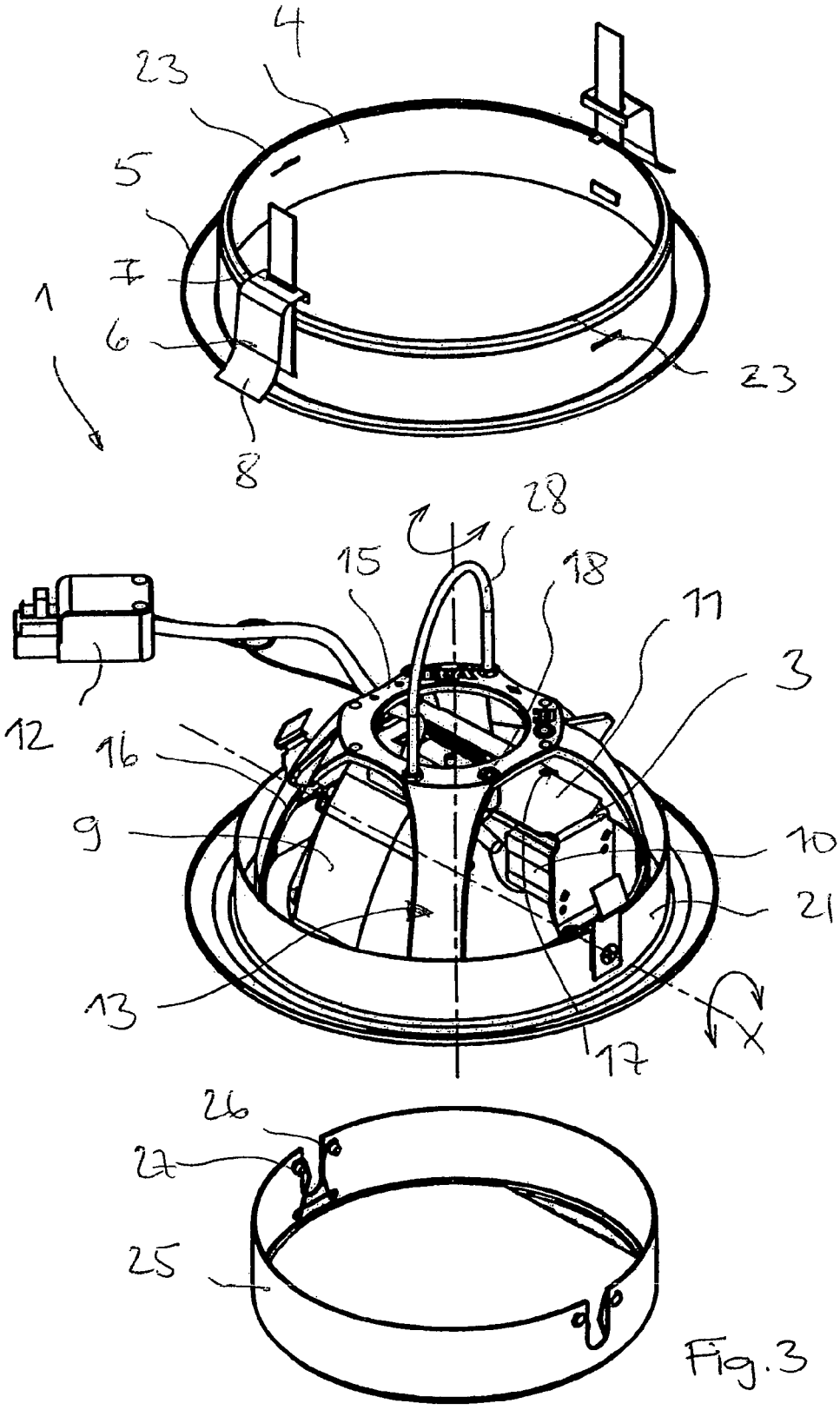
Figure 4:
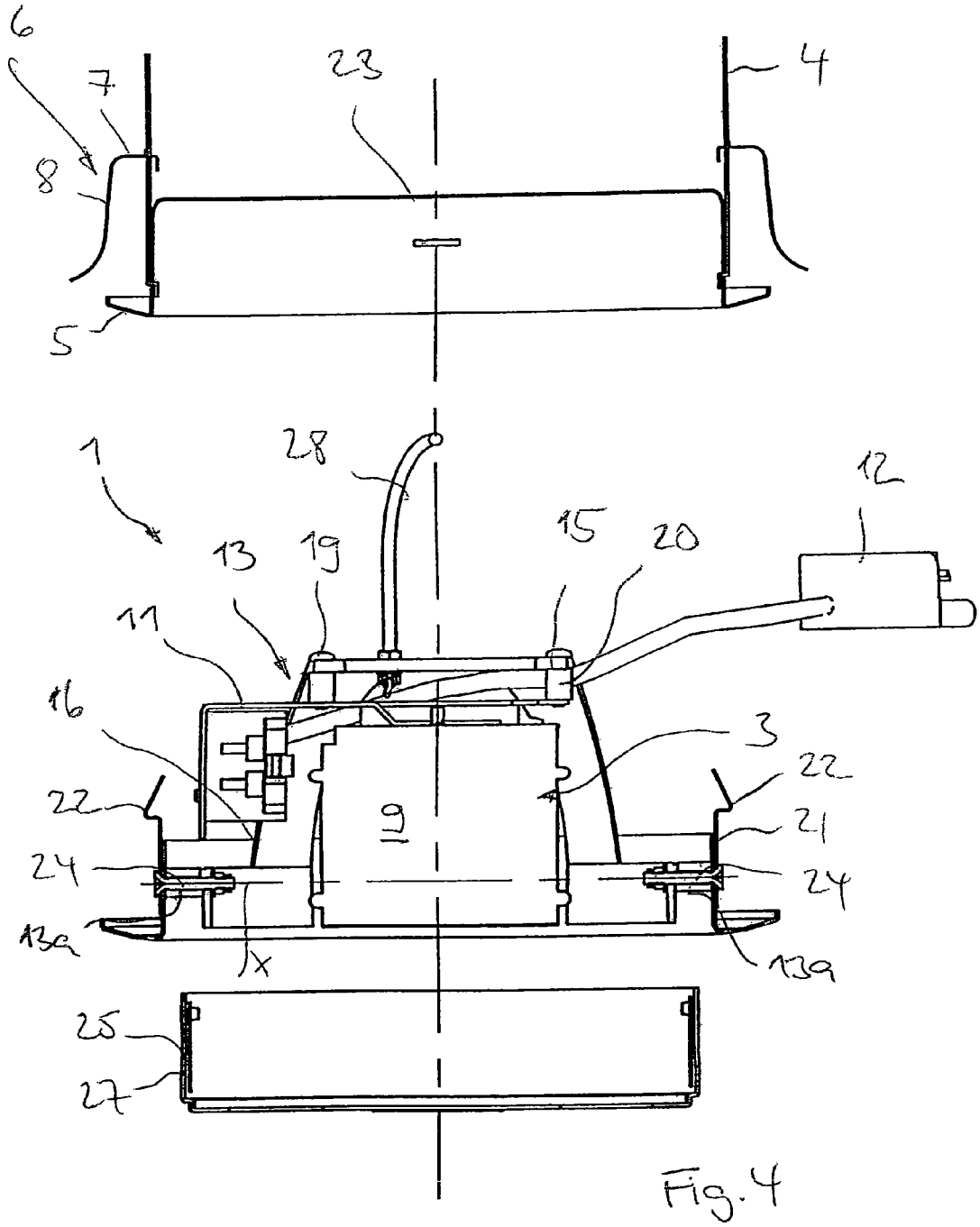

As regards further advantageous embodiments of the invention, reference is made to the sub-claims and to the following description of an exemplary embodiment with reference to the attached drawings. The drawings show as follows:

FIG. 1 a perspective exploded view of an embodiment of a built-in light fixture according to the invention, FIG. 2 a sectional view of the built-in light fixture of FIG. 1, FIG. 3 a perspective exploded view of an alternative embodiment of a built-in light fixture according to the invention, and FIG. 4 a sectional view of the built-in light fixture of FIG. 3.

In FIGS. 1 and 2 a first embodiment of a built-in light fixture 1 according to the present invention is shown which can be fitted into an opening of a suspended ceiling, a thin wall or similar (not shown). The built-in light fixture 1 has a light element which can be inserted into the ceiling opening and which is formed by a light unit 3 containing the light technology and a mounting ring 4.

The mounting ring 4 has a cylindrical base shape with an outer diameter chosen such that it can be inserted into a corresponding round ceiling opening. On its lower side the mounting ring 4 defines a light outlet opening around which the mounting ring 4 carries a flange-type outwardly projecting facing 5. In order to fix the mounting ring 4 onto the ceiling two elastic holding elements 6 are provided on the mounting ring 4 which are positioned diametrically opposite one another and respectively have a stop plate 7 and a flat spring-type tongue element 8 affixed to the latter, in the fitted state the tongue elements 8 engaging behind the wall or ceiling in which the built-in light fixture 1 is fitted and drawing the facing 5 against the front side of the ceiling.

In the embodiment shown the built-in light fixture 1 is round in form. A different design is of course also possible. The built-in light fixture with a light unit 3 and mounting ring 4 can therefore also be rectangular, square or oval in shape.

The light unit 3 comprises a reflector 9—here a reflector 9 which produces so-called batwing light distribution—, which is open on its lower side and carries a bulb socket 10 for a horizontal illuminant (not shown) which is positioned in the upper region of the reflector 9. The reflector 9 and the bulb socket 10 are fixed to a holder 11 which is disposed above the reflector 9. Furthermore, the light unit 3 has a supply plug 12 for connection to an electrical supply unit.

The light unit 3 thus formed is provided in a mounting space of a support frame 13 which surrounds the light unit 3. The support frame 13, which is made of a heat-storing material such as aluminium, for example, and here is in the form of an aluminium die cast part, is formed from a lower base ring 14 surrounding the reflector 9 in the region of its light outlet opening, an upper, also annular cover plate 15 and four struts 16 extending between the base ring 14 and the upper cover plate 15, disposed with an offset of approximately 90° in relation to one another. The light unit 3 is fitted onto this support frame 13 by means of the holder 11 provided on the upper side of the reflector 9. More precisely, two mounting bore holes 17, 18 corresponding to one another are respectively formed in the cover plate 15 of the support frame 13 and the holder 11 of the light unit 3. Attachment screws 19, which are inserted into the mounting bore holes 17 from the upper side of the cover plate 15 and are fixed by attachment nuts (not shown), pass through these two pairs of mounting bore holes 17, 18. Here the distance between the cover plate 15 and the holder 11 is pre-specified by spacer sleeves 20 which are disposed between the cover plate 15 and the holder 11 and through which the attachment screws 17, 18 pass. In this way it is ensured that the light unit 3 is positioned precisely within the support frame 13.

The fitting of the light unit 3 onto the mounting ring 4 is implemented by means of an intermediate ring 21 which surrounds the base ring 14 of the support frame 13 and can be pushed into the mounting ring 4 from below. In its upper end region the intermediate ring 21 carries two diametrically opposed detents 22 which engage resiliently behind the upper edge 23 of the mounting ring 4 when the intermediate ring 21 is pushed into the mounting ring 4 from the lower side of the latter. The advantage of this embodiment is that the intermediate ring 21 can be rotated about the longitudinal axis of the built-in light fixture 1 in relation to the mounting ring 4.

The support frame 13 is held pivotably on the intermediate ring 21. More precisely, a pair of bearing pins 24 defining a pivot axis X are provided which connect the intermediate ring 21 and the base ring 14 to one another and pass through bushings 13 which are moulded onto the support frame 13.

Finally, the built-in light fixture 1 has a filter holding ring 25 the outer diameter of which is chosen such that it can be pushed into the intermediate ring 21 from the lower side of the latter. The filter ring 25 has two recesses 26 which engage with the bushings 13*a* of the support frame 13 when the filter holding ring 25 is pushed into the intermediate ring 21. As can be seen in particular from FIG. 1, disposed in the region of the recesses 26 are U-shaped spring elements 27 with an upwardly-directed opening which are expanded elastically when the recesses 26 engage with the bushings 13*a* and clamp the bushings 13*a* by means of their elastic reset force. The elastic resilience is chosen here such that with a pivot movement of the support frame 13 and so of the light unit 3, the filter holding ring 25 is also pivoted in relation to the intermediate ring 21. At the same time the resilience should be lesser than the clamping force with which the intermediate ring 21 is fixed in the mounting ring 4 so that the filter holding ring 25 can be drawn away from the intermediate ring 21 without the intermediate ring 21 being released from the mounting ring 4.

Finally, an inverted U-shaped spacer 28 is provided on the upper side of the support frame 13 which specifies a minimum clearance which the built-in light fixture 1 must have in the fitted state.

The built-in light fixture 1 according to the invention can be fitted simply. For this purpose the mounting ring 4 is first of all pushed into the opening of a ceiling (not shown). Here the elastic holding elements 6 are pressed together until, in the fully pushed in state, their tongue elements 8 engage behind the wall or ceiling in which the built-in light fixture 1 is fitted and draw the facing 5 against the front side of the ceiling. Next the intermediate ring 21 with the support frame 13 and the light unit 3 held on the latter is pushed into the mounting ring 4 until the detents 22 engage in the recesses 23 of the mounting ring 4, and so the intermediate ring 21 is clamp fixed onto the mounting ring 4. Finally, the filter holding ring 25 is pushed into the intermediate ring 21 and fixed by the spring elements 27 on the bearing pins 24 in the region of the recesses 26.

If the light unit 3 needs to be changed, the intermediate ring 21 with the light unit 3 can be released simply from the mounting ring 4 by the detent connection between the detents 22 and the recesses 23 being released. In order to change the light unit 3 it is only necessary to release the two attachment screws 19 by means of which the light unit 3 is fixed onto the support frame 13. Subsequently, a new light unit 3 can be fixed. If the latter has different height dimensions, it is only necessary to use spacer sleeves 20 and attachment screws 19 with a corresponding height.

For example, FIGS. 3 and 4 show an embodiment of a light fixture according to the invention with which the reflector 9 is substantially higher that the reflector 9 of the first embodiment which is shown in FIGS. 1 and 2. For this reason the attachment screws 19 and the spacer sleeves 20 are considerably shorter in design.

The invention claimed is:

1. A built-in light fixture to be fitted in a suspended ceiling or similar, with a mounting ring insertable into an opening in the ceiling and fixable by holding elements and a light unit which is attached in particular releaseably to the mounting ring, a support frame being fixed to the mounting ring which defines a mounting space for the light unit and has on its upper side facing away from the mounting ring (4) attachment means for fixing the light unit onto the support frame, characterized in that bore holes are formed in the support frame as attachment means, that the light unit has a holder at its upper side, which has mounting bore holes formed therein corresponding to the bore holes in the support frame, and that the light unit is securely fixed to the support frame by attachment screws which extend through the bore holes and the mounting bore holes, the distance between the support frame and the holder being prespecified by spacer sleeves, which are disposed between the support frame and the holder and surround the attachments screws.

2. The built-in light fixture according to claim 1, characterized in that the support frame has a number of struts arranged in particular evenly distributed around the periphery of the mounting ring and which in their lower region in particular are connected to the mounting ring and in their upper region carry the attachment means.

3. The built-in light fixture according to claim 2, characterized in that the attachment means are provided on a flat cover plate of the support frame which connects the struts in their upper end region.

4. The built-in light fixture according to claim 3, characterized in that the cover plate has a central heat discharge opening.

5. The built-in light fixture according to claim 4, characterized in that the cover plate is annular in form.

6. The built-in light fixture according to claim 1, characterized in that in its lower end region facing towards the mounting ring the support frame has a base ring which connects the lower ends of struts and in particular is fixed to the mounting ring.

7. The built-in light fixture according to claim 1, characterized in that the support frame is pivotably fixed onto the mounting ring.

8. The built-in light fixture according to claim 6, characterized in that the support frame is fixed onto the mounting ring by means of an intermediate ring which can be pushed into the mounting ring from the lower side of the latter and is connected, in particular releaseably, to the mounting ring by means of a clamping or detent mechanism.

9. The built-in light fixture according to claim 8, characterized in that in its upper end region the intermediate ring carries a number of detents which lock engage over the upper edge of the mounting ring when the intermediate ring is pushed into the mounting ring from the lower side of the latter.

10. The built-in light fixture according to claim 8, characterized in that the support frame is attached pivotably to the mounting ring or to the intermediate ring by means of bearing pins.

11. The built-in light fixture according to claim 9, characterized in that bushings are provided on the support frame through which the bearing pins pass.

12. The built-in light fixture according to claim 1, characterized in that a filter holding ring is provided which can be pushed into the mounting ring or the intermediate ring and can be releaseably fixed onto the support frame by means of a clamping mechanism.

13. The built-in light fixture according to claim 11, characterized in that the filter holding ring has recesses corresponding to the bushings and spring elements are provided on the filter holding ring in order to clamp fix the bushings in the recesses.

14. The built-in light fixture according to claim 13, characterized in that the recesses in the filter holding ring are formed such that the bushings are pivotably moveable in the latter.

15. The built-in light fixture according to claim 9, characterized in that the holding force of the clamping or detent mechanism by means of which the intermediate ring and the mounting ring are connected to one another is stronger than the clamping mechanism by means of which the filter holding ring is fixed to the intermediate ring.

16. The built-in light fixture according to claim 1, characterized in that on the upper side of the support frame facing away from the mounting ring a spacer is provided which defines a minimum required clearance above the support frame.

17. The built-in light fixture according to claim 1, characterized in that the support frame is made of a heat-storing material, and in particular aluminum aluminium.

18. The built-in light fixture according to claim 12, characterized in that the holding force of the clamping or detent mechanism by means of which the intermediate ring and the mounting ring (4) are connected to one another is stronger than the clamping mechanism by means of which the filter holding ring is fixed to the intermediate ring.

19. The built-in light fixture according to claim 13, characterized in that the holding force of the clamping or detent mechanism by means of which the intermediate ring and the mounting ring are connected to one another is stronger than the clamping mechanism by means of which the filter holding ring is fixed to the intermediate ring.

* * * * *